US011193476B2

(12) United States Patent
Cho et al.

(10) Patent No.: US 11,193,476 B2
(45) Date of Patent: Dec. 7, 2021

(54) SCROLL COMPRESSOR

(71) Applicant: SAMSUNG ELECTRONICS CO., LTD., Suwon-si (KR)

(72) Inventors: Yang-hee Cho, Seoul (KR); Moo-seong Bae, Suwon-si (KR); Sung-kwang Oh, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 235 days.

(21) Appl. No.: 16/468,205

(22) PCT Filed: Dec. 21, 2017

(86) PCT No.: PCT/KR2017/015224
§ 371 (c)(1),
(2) Date: Jun. 10, 2019

(87) PCT Pub. No.: WO2018/117682
PCT Pub. Date: Jun. 28, 2018

(65) Prior Publication Data

US 2020/0080547 A1 Mar. 12, 2020

(30) Foreign Application Priority Data

Dec. 21, 2016 (KR) ..... 10-2016-0175737

(51) Int. Cl.
*F04C 18/02* (2006.01)
*F04C 29/02* (2006.01)
(Continued)

(52) U.S. Cl.
CPC ..... *F04B 39/16* (2013.01); *F04C 2/086* (2013.01); *F04C 18/0215* (2013.01);
(Continued)

(58) Field of Classification Search
CPC ..... F04C 18/0215; F04C 18/3443; F04C 18/0253; F04C 29/02; F04C 29/026;
(Continued)

(56) References Cited

U.S. PATENT DOCUMENTS 5,759,020 A * 6/1998 Shaffer ..... F01C 17/06 418/142
8,182,249 B2 5/2012 Sugimoto et al.
(Continued)

FOREIGN PATENT DOCUMENTS

CN 102678208 A 9/2012
CN 102678549 A 9/2012
(Continued)

OTHER PUBLICATIONS

English translation of EP-1818541 by Espacenet, Jan. 25, 2021.*
(Continued)

*Primary Examiner* — Deming Wan
(74) *Attorney, Agent, or Firm* — Staas & Halsey, LLP

(57) ABSTRACT

A scroll compressor is provided which comprises: a housing; a driving motor; an orbiting scroll rotated by the driving motor; a fixed scroll; a suction port provided in the housing and suctioning a refrigerant; an oil separator in the housing at one side of the fixed scroll; and a discharge port for discharging, to the outside of the housing, the refrigerant from which oil is separated in the oil separator. The scroll compressor includes an intermediate housing; a back pressure chamber in the intermediate housing at one side of the orbiting scroll, first and second back pressure seal members in the intermediate housing; a plurality of anti-rotation rings in the intermediate housing; and a plurality of anti-rotation pins at the orbiting scroll to be inserted into each of the plurality of anti-rotation rings.

14 Claims, 14 Drawing Sheets

(51) Int. Cl.

| | |
|---|---|
| ***F04C 2/344*** | (2006.01) |
| ***F04C 28/22*** | (2006.01) |
| ***F04C 27/00*** | (2006.01) |
| ***F01C 1/02*** | (2006.01) |
| ***F01C 19/08*** | (2006.01) |
| ***F04B 39/16*** | (2006.01) |
| ***F04C 18/08*** | (2006.01) |
| ***F04C 2/08*** | (2006.01) |

(52) U.S. Cl.
CPC ..... *F04C 18/086* (2013.01); *F04C 27/005* (2013.01); *F04C 2210/26* (2013.01); *F04C 2240/102* (2013.01); *F04C 2240/30* (2013.01); *F04C 2240/40* (2013.01)

(58) Field of Classification Search
CPC ..... F01C 1/02; F01C 1/0215; F01C 1/0253; F01C 19/08
See application file for complete search history.

(56) References Cited

U.S. PATENT DOCUMENTS

| | | | | |
|---|---|---|---|---|
| 2002/0098102 | A1 | 7/2002 | Gennami et al. | |
| 2007/0178002 | A1* | 8/2007 | Hiwata | F04C 18/0276 418/55.2 |
| 2011/0044835 | A1* | 2/2011 | Nomura | F04C 29/026 418/55.6 |
| 2014/0037485 | A1* | 2/2014 | Schneider | F04C 18/0215 418/55.1 |
| 2014/0134033 | A1* | 5/2014 | Tozawa | F01C 17/06 418/55.3 |
| 2014/0178232 | A1 | 6/2014 | Nagano et al. | |
| 2018/0347568 | A1 | 12/2018 | Moon et al. | |

FOREIGN PATENT DOCUMENTS

| | | | | |
|---|---|---|---|---|
| CN | 102985696 | A | 3/2013 | |
| CN | 103899537 | A | 7/2014 | |
| CN | 105201826 | A | 12/2015 | |
| CN | 105697372 | A | 6/2016 | |
| CN | 105805001 | A | 7/2016 | |
| CN | 205478294 | U | 8/2016 | |
| EP | 1818541 | A1 * | 8/2007 | F04C 18/0215 |
| JP | 57-76291 | | 5/1982 | |
| JP | 2004-124906 | | 4/2004 | |
| JP | 2008-138586 | | 6/2008 | |
| JP | 4262949 | | 5/2009 | |
| JP | 2010-1858 | | 1/2010 | |
| JP | 2012-189043 | | 10/2012 | |
| JP | 2012-207547 | | 10/2012 | |
| KR | 2002-0000360 | | 1/2002 | |
| KR | 10-0390503 | | 7/2003 | |
| KR | 10-2004-0041394 | | 5/2004 | |
| KR | 10-2005-0082634 | | 8/2005 | |
| KR | 10-0548449 | | 2/2006 | |
| KR | 10-0556941 | | 3/2006 | |
| KR | 10-0608865 | | 8/2006 | |
| KR | 10-0619723 | | 9/2006 | |
| KR | 10-0873680 | | 12/2008 | |
| KR | 10-2009-0102673 | | 9/2009 | |
| KR | 10-2010-0018221 | | 2/2010 | |
| KR | 10-2013-0025649 | | 3/2013 | |
| KR | 10-2013-0074392 | | 7/2013 | |
| KR | 10-2014-0101181 | | 8/2014 | |
| KR | 10-2015-0020795 | | 2/2015 | |
| KR | 10-2015-0081782 | | 7/2015 | |
| KR | 10-1558030 | | 10/2015 | |
| KR | 10-2016-0090673 | | 8/2016 | |
| KR | 10-2016-0138750 | | 12/2016 | |
| WO | 2016/190490 | | 12/2016 | |

OTHER PUBLICATIONS

Chinese Office Action dated May 29, 2020 in Chinese Patent Application No. 201780079586.7.
Extended European Search Report dated Oct. 4, 2019 in European Patent Application No. 17882606.1.
International Search Report dated Apr. 9, 2018 in corresponding International Patent Application No. PCT/KR2017/015224 (2 pages).
Written Opinion of the International Searching Authority dated Apr. 9, 2018 in corresponding International Patent Application No. PCT/KR2017/015224 (8 pages).
Chinese Office Action dated Feb. 2, 2021 in Chinese Patent Application No. 201780079586.7.
Chinese Office Action dated Jul. 28, 2021 from Chinese Application No. 201780079586.7.

* cited by examiner

SCROLL COMPRESSOR

CROSS-REFERENCE TO RELATED APPLICATIONS

This application is a U.S. National Stage Application which claims the benefit under 35 U.S.C. § 371 of International Patent Application No. PCT/KR2017/015224 filed on Dec. 21, 2017, which claims foreign priority benefit under 35 U.S.C. § 119 of Korean Patent Application No. 10-2016-0175737 filed Dec. 21, 2016, the entire contents of both of which are incorporated herein by reference.

TECHNICAL FIELD

The present disclosure relates to a scroll compressor, and more particularly to a low pressure lateral scroll compressor.

BACKGROUND ART

A scroll compressor is a refrigerant compressor that compresses a refrigerant and is used in various air conditioners because it has high efficiency, low vibration, and low noise as compared with other types of compressors such as a rotary compressor and the like.

Generally, the scroll compressor includes a fixed scroll and an orbiting scroll that revolves relative to the fixed scroll. A fixed scroll wrap of the fixed scroll and an orbiting scroll wrap of the orbiting scroll are engaged with each other to form to plurality of compression chambers for compressing, the refrigerant.

Therefore, when the refrigerant is compressed by the fixed scroll and the orbiting scroll, it is necessary to prevent the gap between the fixed scroll and the orbiting scroll from being widened by the pressure of the compressed refrigerant.

To this end, a back pressure chamber is provided at one side of the orbiting scroll to receive an intermediate pressure to push the orbiting scroll toward the fixed scroll. Particularly, in the low-pressure scroll compressor, it is necessary to keep the pressure of the back pressure chamber constant to increase the efficiency of the scroll compressor.

To this end, the conventional low-pressure scroll compressor seals a gap between the orbiting scroll and the intermediate housing which supports the rotary shaft for rotating the orbiting scroll by providing a back pressure seal member in the orbiting scroll.

However, because the back pressure seal member is provided in the revolving orbiting scroll, the back pressure seal member may be shaken by the revolving of the orbiting scroll. Therefore, there is a problem that the sealing ability of the back pressure seal member is lowered and the sealing of the back pressure chamber is lowered.

Further, because the back pressure seal member is provided in the orbiting scroll that performs the orbiting motion, the centrifugal force acting in the radial direction of the back pressure seal member is different so that the sealing ability of the back pressure seal member becomes lowered and the sealing of the back pressure chamber is deteriorated.

In addition, the conventional scroll compressor is provided with a screw-shaped flow path in the oil supply passage, and supplies the oil separated from the refrigerant discharged from the fixed scroll to the back pressure chamber. However, the screw-shaped flow path is difficult to manufacture and assemble, resulting in many defects.

DISCLOSURE OF INVENTION

The present disclosure has been developed in order to overcome the above drawbacks and other problems associated with the conventional arrangement. An aspect of the present disclosure relates to a scroll compressor capable of improving sealing of a back pressure chamber and supply of oil to the back pressure chamber.

According to an aspect of the present disclosure, a scroll compressor includes a housing, a driving motor accommodated in the housing, an orbiting scroll orbited by the driving motor, a fixed scroll disposed in the housing and forming a compression chamber together with the orbiting scroll, a suction port provided in the housing at one side of the driving motor and configured to suck refrigerant, an oil separator provided in the housing at one sale of the fixed scroll and configured to separate oil from the refrigerant discharged from the fixed scroll, and a discharge port configured to discharge the refrigerant from which oil has been separated in the oil separator to an outside of the housing. The scroll compressor may include an intermediate housing disposed in the housing and rotatably supporting a rotary shaft of the driving motor; a back pressure chamber provided in the intermediate housing at one side of the orbiting scroll; a first back pressure seal member disposed in the intermediate housing to surround a periphery of the back pressure chamber and configured to seal a imp between the orbiting scroll and the intermediate housing a second back pressure seal member disposed in the intermediate housing at one end of the back pressure chamber and configured to seal a gap between the rotary shaft and the intermediate housing; a plurality of anti-rotation rings disposed in the intermediate housing at an outer side of the first back pressure seal member; and a plurality of anti-rotation pins provided in the orbiting scroll and inserted into, the plurality of anti-rotation rings, respectively.

An oil supply passage through which the oil separated by the oil separator moves to the back pressure chamber may be provided between the oil separator and the back pressure chamber, and an orifice pin may be disposed in the oil supply passage.

The oil supply passage may include a first oil supply passage provided in the fixed scroll and a second oil supply passage provided in the intermediate housing and communicated with the first oil supply passage.

An outer diameter of the orifice pin may be smaller than an inner diameter of the first oil supply passage.

The intermediate housing may be provided with an annular seal member groove at an outer side of the back pressure chamber, and the first back pressure seal member may be disposed in the seal member groove.

The scroll compressor may include a third back pressure seal member disposed in the orbiting scroll to surround the plurality of anti-rotation rings and configured to seal a gap between the orbiting scroll and the intermediate housing.

A sub-back pressure chamber may be formed between the first back pressure seal member and the third back pressure seal member and configured to supply oil to the plurality of anti-rotation rings.

The orbiting scroll may include an annular sub-seal member groove formed at an outer side of the plurality of anti-rotation pins; and the third back pressure seal member may be disposed in the sub-seal member groove.

The orbiting scroll may be provided with a first back pressure hole communicating the back pressure chamber with the compression chamber, and the first back pressure hole may be formed adjacent to an inner circumferential surface of an orbiting scroll wrap of the orbiting scroll.

The orbiting scroll may be provided with a second back pressure hole communicating the sub-back pressure chamber with the compression chamber, and the second back pressure hole may be formed adjacent to an outer circumferential surface of the orbiting scroll wrap of the orbiting scroll.

According to another aspect of the present disclosure, a scroll compressor includes a housing, a driving motor accommodated in the housing, an orbiting scroll orbited by the driving motor, a fixed scroll disposed in the housing and forming a compression chamber together with the orbiting scroll, a suction port provided in the housing at one side of the driving motor and configured to suck refrigerant, an oil separator provided in the housing at one side of the fixed scroll and configured to separate oil from the refrigerant discharged from the fixed scroll, and a discharge port configured to discharge the refrigerant from which oil has been separated in the oil separator to an outside of the housing. The scroll compressor may include an intermediate housing disposed in the housing and rotatably supporting a rotary shaft of the driving motor; a back pressure chamber provided in the intermediate housing at one side of the orbiting scroll; a first back pressure seal member disposed in the intermediate housing to surround a periphery of the back pressure chamber and configured to seal a gap between the orbiting scroll and the intermediate housing; a second back pressure seal member disposed in the intermediate housing at one end of the back pressure chamber and configured to seal a gap between the rotary shaft and the intermediate housing; and an orifice pin provided in an oil supply passage formed between the oil separator and the back pressure chamber and configured to supply the oil separated in the oil separator to the back pressure chamber.

The oil supply passage may include a first oil supply passage provided in the fixed scroll and a second oil supply passage provided in the intermediate housing and communicated with the first oil supply passage.

BEST MODE FOR CARRYING OUT THE INVENTION

Hereinafter, embodiments of a scroll compressor according to the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 1:
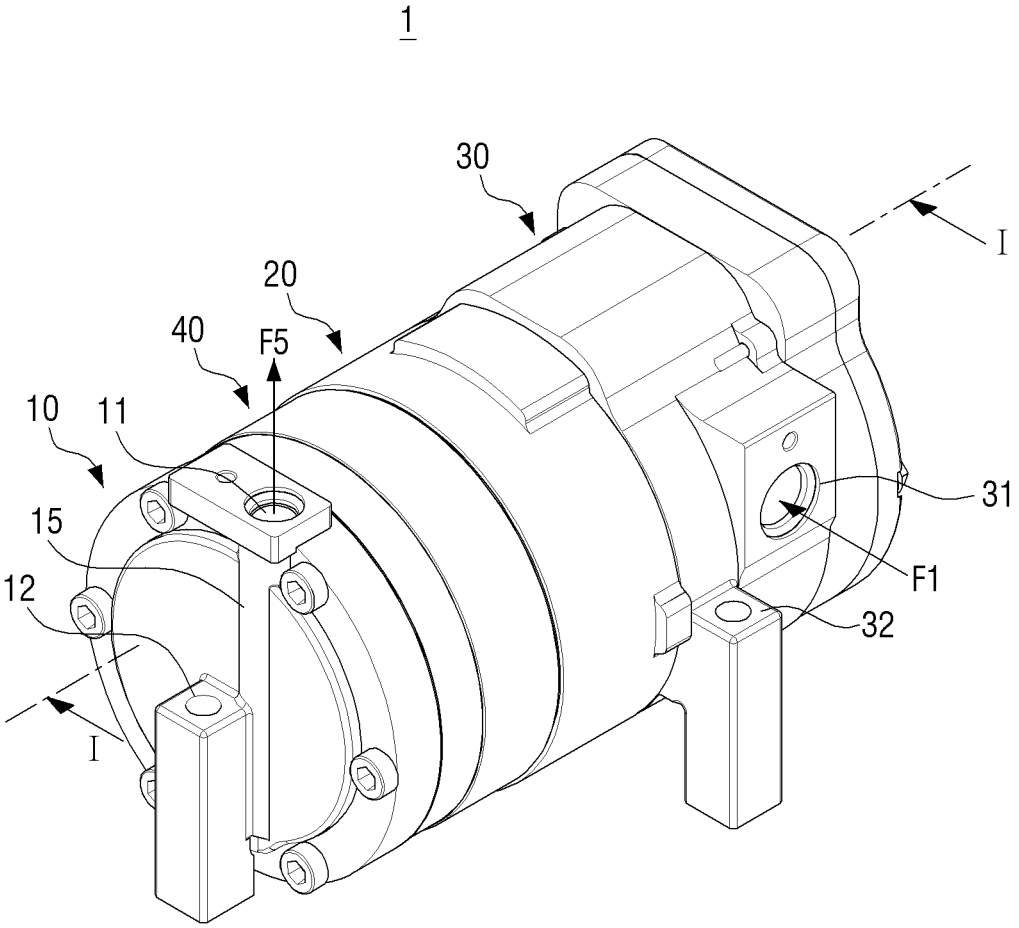
FIG. 1 is a perspective view illustrating a scroll compressor according to an embodiment of the present disclosure.
Figure 2:
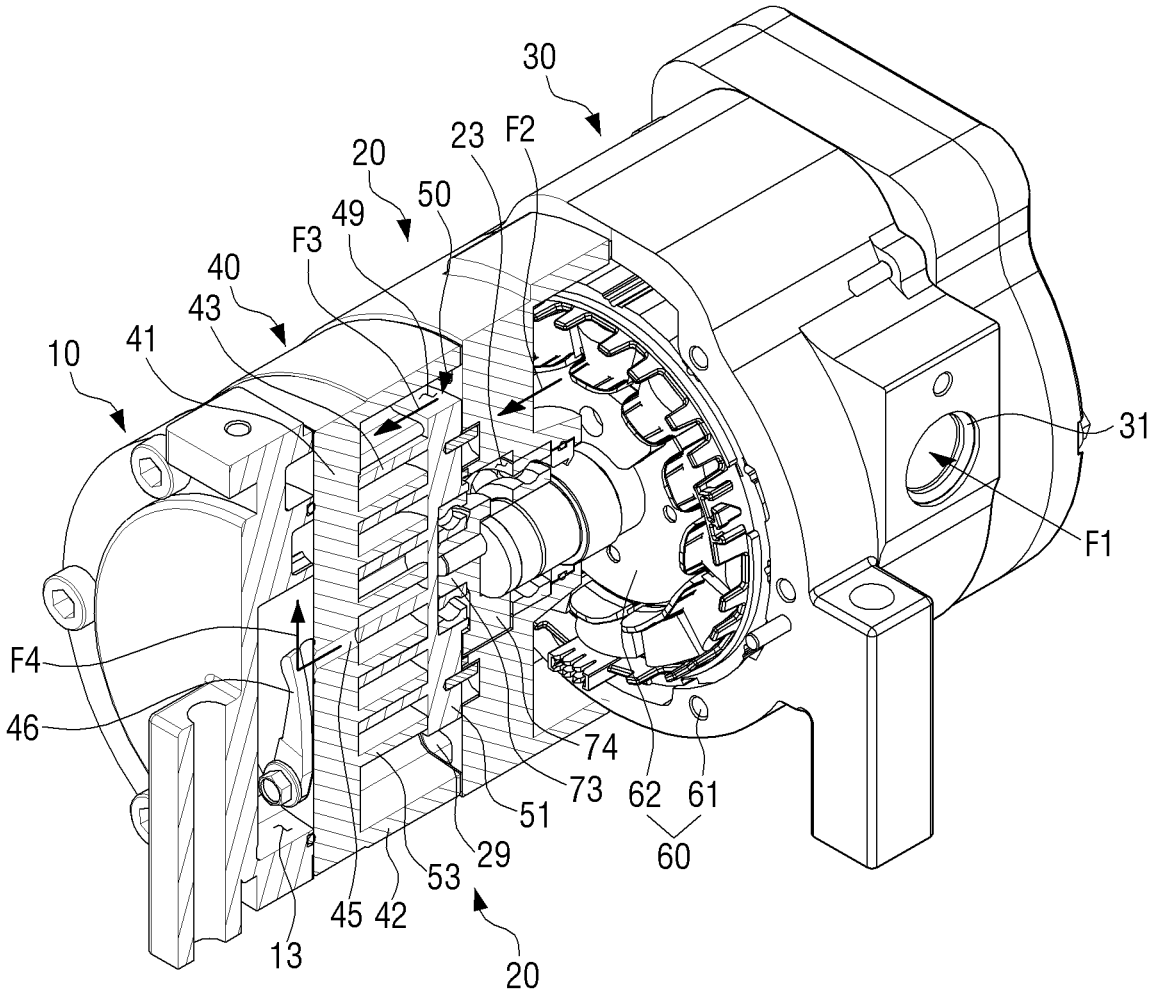
FIG. 2 is a partial cross-sectional perspective view of the scroll compressor of FIG. 1.
Figure 3:
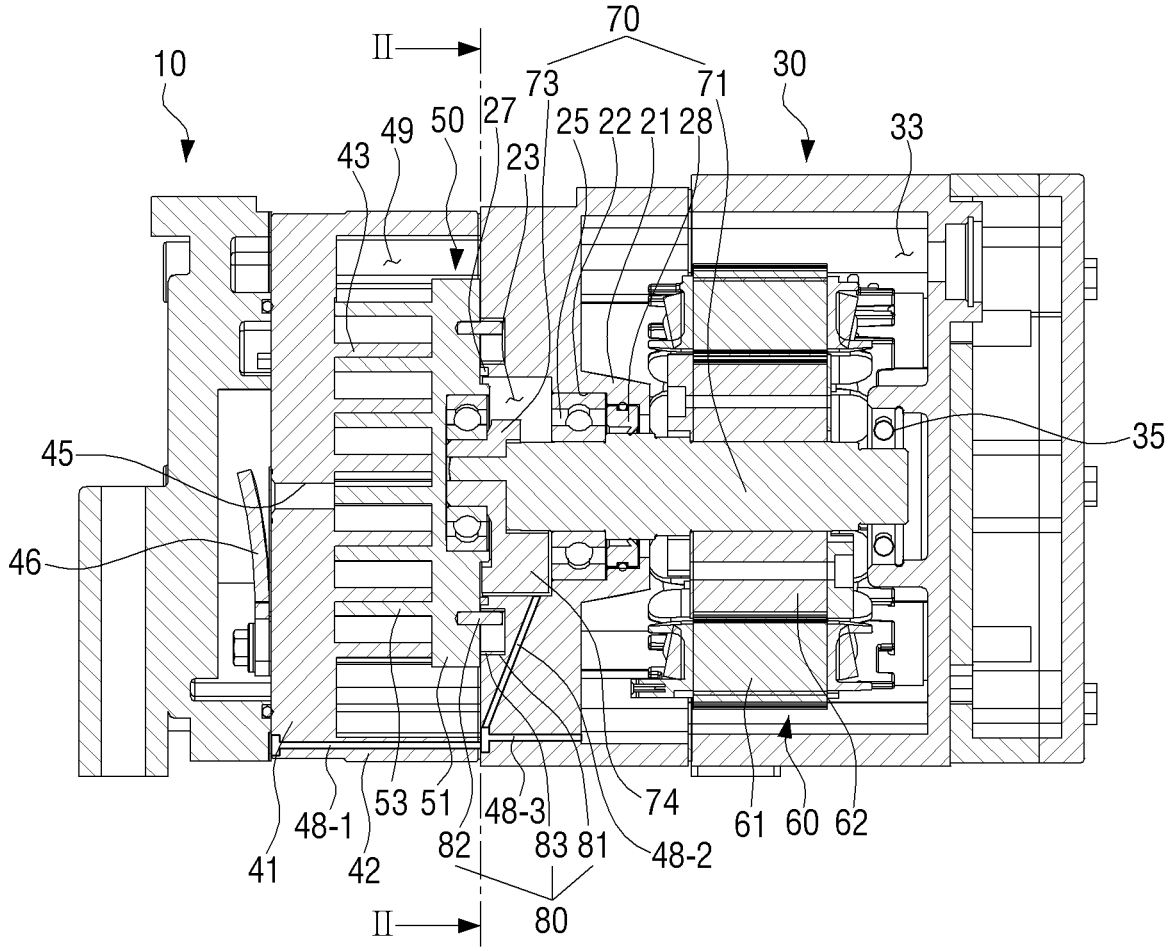
FIG. 3 is a cross-sectional view of the scroll compressor of FIG. 1 taken along line I-I.
Figure 4:
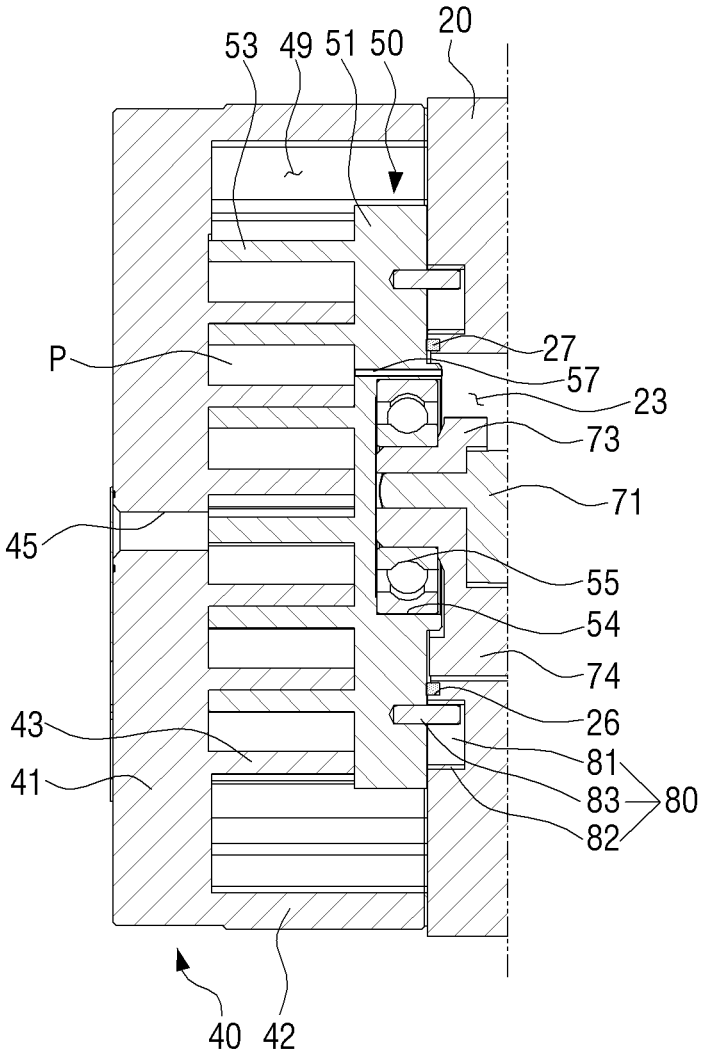
FIG. 4 is a partial cross-sectional view illustrating a back pressure chamber of a scroll compressor according to an embodiment of the present disclosure.
Figure 5:
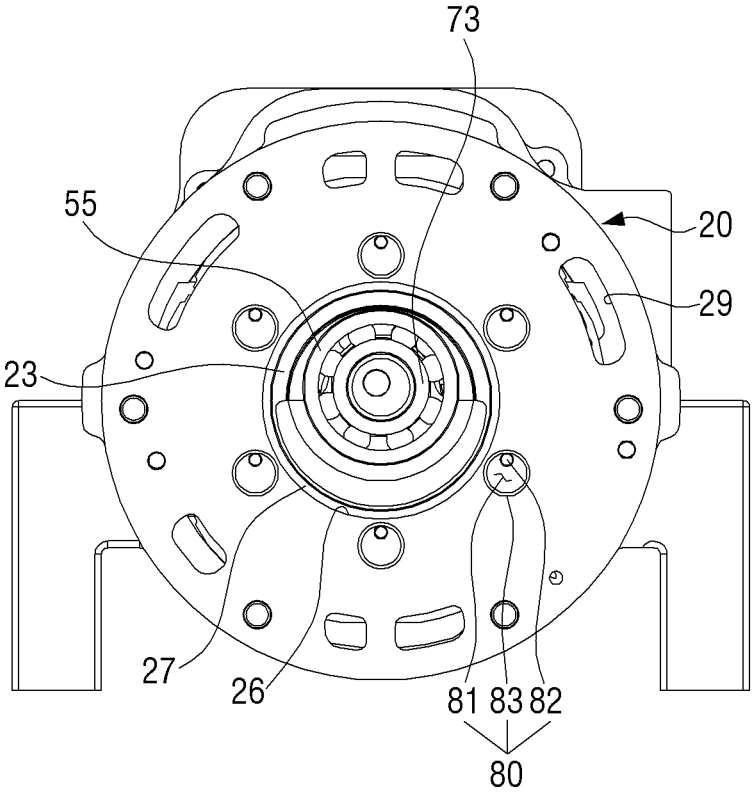
FIG. 5 is a cross-sectional view of the scroll compressor of FIG. 3 taken along line II-II.
Figure 6:
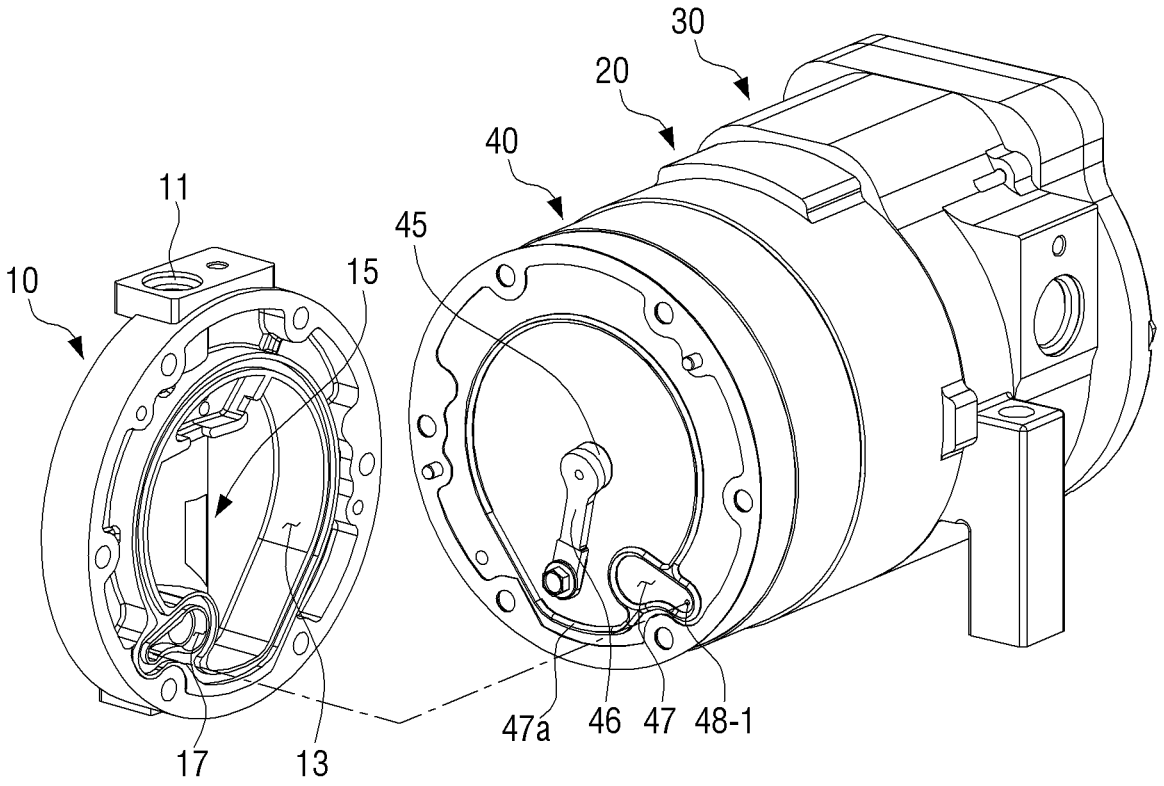
FIG. 6 is a perspective view illustrating a slate in which a front housing is separated from the scroll compressor of FIG. 1.

FIG. 1 is a perspective view illustrating a scroll compressor according to an embodiment of the present disclosure. FIG. 2 is a partial cross-sectional perspective view of the scroll compressor of FIG. 1, and FIG. 3 is a cross-sectional view of the scroll compressor of FIG. 1 taken along line I-I. FIG. 4 is a partial cross-sectional view illustrating a back pressure chamber of a scroll compressor according to an embodiment of the present disclosure. FIG. 5 is a cross-sectional view of the scroll compressor of FIG. 3 taken along line II-II. FIG. 6 is a perspective view illustrating a state in which a front housing is separated from the scroll compressor of FIG. 1.

Referring to FIGS. 1 to 3, a scroll compressor 1 according to an embodiment of the present disclosure may include a housing 10, 20, and 30, a fixed scroll 40, an orbiting scroll 50, and a driving motor 60.

The housing 10, 20, and 30 forms the outer appearance of the scroll compressor 1 and may include a front housing 10, an intermediate housing 20, and a rear housing 30. The front housing 10 is provided with a discharge port 11 for discharging a refrigerant. The discharge port 11 may be connected to a refrigerant pipe (not illustrated) connected to a condenser (not illustrated) of a refrigerant cycle. The rear housing 30 is provided with a suction port 31 through which the refrigerant is sucked. The suction port 31 may be connected to a refrigerant pipe (not illustrated) connected to an evaporator (not illustrated) of the refrigerant cycle. Therefore, the refrigerant drawn into suction port 31 of the rear housing 30 passes through the interior of the rear housing 30 and the intermediate housing 20 and is discharged to the outside of the scroll compressor 1 through the discharge port 11 of the front housing 10. The inside of the rear housing 30 forms a motor chamber 33 in which the driving motor 60 is disposed.

The intermediate housing 20 is disposed on one side of the rear housing 30 and is configured to support one end portion of the driving motor 60. A refrigerant compression mechanism 40 and 50 is provided between the intermediate housing 20 and the front housing 10.

Referring to FIGS. 3 to 5, the intermediate housing 20 is formed in a disc shape and a protruding portion 21 is thrilled on one surface of the intermediate housing 20 facing the rear housing 30. A shall support hole 22 is formed in the protruding portion 21 of the intermediate housing 20 and an intermediate bearing 25 is provided in the shaft support hole 22. A main shaft portion 71 of a rotary shaft 70 is inserted into the intermediate bearing 25, so that the intermediate bearing 25 support the rotation of the rotary shaft 70. Further, the intermediate housing 20 is provided with a back pressure chamber 23 having an inner diameter larger than the inner diameter of the shaft support hole 22 at one side of the shaft support hole 22.

An annular seal member groove 26 is provided around the back pressure chamber 23 on one surface of the intermediate housing 20. The seal member groove 26 is provided with a first back pressure seal member 27 for sealing a gap between the orbiting scroll 50 and the intermediate housing 20. The first back pressure seal member 27 may be disposed to be movable in a direction perpendicular to the one surface of the intermediate housing 20, that is, in the axial direction of the scroll compressor 1 with respect to the seal member groove 26. Therefore, the tip end of the first back pressure seal member 27 disposed in the seal member groove 26 contacts the orbiting scroll 50 to prevent the refrigerant in the back pressure chamber 23 from flowing out of the back pressure chamber 23. The first back pressure seal member 27 is formed in a ring shape and may be formed of a sealable material such as rubber.

In addition, an anti-rotation mechanism 80 is provided between the orbiting scroll 50 and the intermediate housing 20 to prevent the orbiting scroll 50 from rotating. The anti-rotation mechanism 80 may be formed in a pin and ring structure. For example, a plurality of anti-rotation ring grooves 81 are provided around the seal member groove 26 of the intermediate housing 20, and a plurality of anti-rotation pins 82 are provided on one surface of the orbiting scroll 50 facing the intermediate housing 20. The plurality of anti-rotation ring grooves 81 provided in the intermediate housing 20 are formed to have a circular cross-section with a predetermined depth. The plurality of anti-rotation pins 82 of the orbiting scroll 50 are provided in the same number as the plurality of anti-rotation ring grooves 81 of the intermediate housing 20 and are inserted into the plurality of anti-rotation ring grooves 81. A plurality of anti-rotation rings 83 may be inserted in the plurality of anti-rotation ring grooves 81. In this case, when the orbiting scroll 50 orbits, the rotation of the orbiting scroll 50 may be prevented because the movement of the plurality of anti-rotation pins 82 of the orbiting scroll 50 is restricted by the plurality of anti-rotation rings 83 provided in the intermediate housing 20. When the plurality of anti-rotation rings 83 are provided in the intermediate housing 20 as in this embodiment, the size of the orbiting scroll 50 may be reduced as compared with the case where the plurality of anti-rotation pins are provided in the orbiting scroll 50. Therefore, there is an advantage that the size of the orbiting scroll 50 may be minimized.

A second back pressure seal member 28 is provided at one end of the back pressure chamber 23 provided in the intermediate housing 20. For example, the second back pressure seal member 28 may be disposed at one side of the intermediate bearing 25 at one end of the protruding portion 21 provided in the intermediate housing 20. The second back pressure seal member 28 is provided to seal a gap between the rotary shaft 70 of the driving motor 60 and the intermediate housing 20. The second back pressure seal member 28 may use a lip seal. As described above, when the second back pressure seal member 28 is disposed at the protruding portion 21 provided on the one surface of the intermediate housing 20 adjacent to the driving motor 60, the refrigerant in the back pressure chamber 23 in the high pressure state is prevented from leaking to the motor chamber 33 provided with the driving motor 60 through which the to pressure refrigerant passes, so that the back pressure of the back pressure chamber 21 may be maintained.

A plurality of openings 29 penetrating the intermediate housing 20 are formed near the outer circumferential surface of the intermediate housing 20. The plurality of openings 29 may be arranged in a substantially circular shape with respect to the center of the intermediate housing 20. The plurality of openings 29 allow the motor chamber 33 of the rear housing 30 in which the driving motor 60 is disposed to communicate with the compression chamber 49 provided in the fixed scroll 40 so that the refrigerant flowing into the rear housing 30 is moved to the compression chamber 49. Therefore, as illustrated in FIG. 5, the intermediate housing 20 includes the back pressure chamber 23, the plurality of ring grooves 81, and plurality of openings 29 concentrically provided on the one surface of the intermediate housing 20.

The fixed scroll 40 is disposed on the opposite side of the rear housing 30 at one side of the intermediate housing 20. The orbiting scroll 50 is accommodated in a space 49 formed by the fixed scroll 40 and the intermediate housing 20. The orbiting scroll 50 is disposed between the fixed scroll 40 and the intermediate housing 20, so that the orbiting scroll 50 meshes with the fixed scroll 40 and performs an orbiting motion with respect to the fixed scroll 40. The fixed scroll 40 and the orbiting scroll 50 form a compression mechanism for compressing the refrigerant.

The fixed scroll 40 includes a fixed plate 41 and a fixed scroll wrap 43. The fixed plate 41 is formed in a substantially disc shape and the fixed scroll wrap 43 is formed in an involute curve shape having a predetermined thickness and height on one surface of the fixed plate 41. At the center of the fixed plate 41, a discharge hole 45 penetrating the fixed plate 41 is formed. A discharge valve 46 is provided in the discharge hole 45 to prevent the refrigerant from flowing backward.

In addition, a cylindrical skirt 42 is provided on the outer periphery of the fixed plate 41. The skirt 42 surrounds the space between the fixed plate 41 and the intermediate, housing 20 and forms a space in which the orbiting scroll 50 orbits. The skirt 42 extends vertically to the fixed plate 41 from the outer periphery of the fixed plate 41 and is formed as a single body with the fixed plate 41. The space 49 inside the fixed scroll 40, that is, the compression space is in fluid communication with the motor chamber 33 of the rear housing 30 through the plurality of openings 29 formed in the intermediate housing 20. Therefore, the refrigerant introduced through the rear housing 30 (arrow F1 in FIGS. 1 and 2) is introduced into the inner space 49 of the fixed scroll 40 through the plurality of openings 29 of the intermediate housing 20 (arrow F3 in FIGS. 1 and 2).

The orbiting scroll 50 includes an orbiting plate 51 and an orbiting scroll wrap 53. The orbiting plate 51 is formed in a disc shape. The orbiting scroll wrap 53 is provided on one surface of the orbiting plate 51 facing the fixed scroll 40 and is formed in an involute curve shape baying a predetermined thickness and height. The orbiting scroll wrap 53 is formed to mesh with the fixed scroll wrap 43 of the fixed scroll 40. A space formed between the fixed scroll wrap 43 of the fixed scroll 40 and the orbiting scroll wrap 53 of the orbiting scroll 50 forms a compression pocket P for compressing the refrigerant. Therefore, when the orbiting scroll 50 orbits, the refrigerant is compressed by the compression pocket P between the orbiting scroll wrap 53 and the fixed scroll wrap 43, and then discharged through the discharge hole 45 of the fixed scroll 40.

A bearing groove 54 is provided at the center of one surface of the orbiting plate 51 opposite to the surface on which the orbiting scroll wrap 53 is formed. The bearing groove 54 is provided with a front bearing 55 for rotatably supporting one end portion of the rotary shaft 70. Further, the orbiting plate 5 the orbiting scroll 50 is provided with a back pressure hole 57 for communicating the compression chamber 49 and the back pressure chamber 23 to each other. Accordingly, a part of the high-pressure refrigerant compressed by the orbiting scroll 50 and the fixed scroll 40 is moved to the back pressure chamber 23 through the back pressure hole 57. Thus, the refrigerant introduced into the back pressure chamber 23 presses the orbiting scroll 50 toward the fixed scroll 40 in the axial direction (the direction of arrow B) under the intermediate pressure. At this time, the pressure applied to the hack pressure chamber 23 is the intermediate pressure that is lower than the pressure of the refrigerant discharged through the discharge hole 45 of the fixed scroll 40 and higher than the pressure of refrigerant introduced through the suction port 31 of the rear housing 30.

The front housing 10 is provided on one side of the fixed scroll 40, that is, on one surface of the fixed scroll 40 provided with the discharge hole 45. A refrigerant discharge chamber 13 is provided between the front housing 10 and the fixed scroll 40. A discharge valve 46 for opening and closing the discharge hole 45 of the fixed scroll 40 is provided in the refrigerant discharge chamber 13.

Further, as illustrated in FIG. 6, an oil separator 15 is provided in the refrigerant discharge chamber 13 of the front housing 10. The oil separator 15 may be formed to separate oil from the high-pressure refrigerant introduced into the refrigerant discharge chamber 13 through the discharge hole 45 of the fixed scroll 40. Because the oil separator 15 is the same as or similar to the oil separator used in the conventional scroll compressor, the detailed description thereof is omitted. An oil collecting space 17 in which the separated oil is collected is provided below the oil separator 15 of the front housing 10.

The high-pressure refrigerant whose oil has been removed by the oil separator 15 is discharged to the outside of the scroll compressor 1 through the discharge port 11 provided in the front housing 10. As an example, the high-pressure refrigerant discharged through the discharge port 11 of the scroll compressor 1 may be introduced into, for example, a condenser (not illustrated).

On the other hand, the oil separated from the high-pressure refrigerant by the oil separator 15 is supplied to the back pressure chamber 23 and the motor chamber 33 to lubricate the friction portions. To this end, in one surface of the fixed scroll 40, an oil collecting part 47 forming the lower surface of the oil collecting space 17 where the oil separated by the oil separator 15 is collected and a first oil supply passage 48-1 for supplying the oil in the oil collecting space 17 to the back pressure chamber 23 of the intermediate housing 20 may be provided. The oil collecting part 47 is isolated from the refrigerant discharge chamber 13 by a seal member 47*a*. The inlet of the first oil supply passage 48-1 is provided in the oil collecting part 47.

The first oil supply passage 48-1 may be formed as a through hole passing through the skirt 42 of the fixed scroll 40. The inlet of the first oil supply passage 48-1 is provided to communicate with the oil collecting space 17 in the oil collecting part 47. Therefore, the oil separated in the oil separator 15 is supplied to the first oil supply passage 48-1 through the oil collecting space 17.

The intermediate housing 20 may be provided with a second oil supply passage 48-2 for supplying the oil supplied to the first oil supply passage 48-1 to the back pressure chamber 23. The second oil supply passage 48-2 may be formed as a through hole connecting the one surface of the intermediate housing 20 facing the fixed, scroll 40 and the inner side surface of the back pressure chamber 23. The inlet of the second oil supply passage 48-2 is provided to communicate with the outlet of the first oil supply passage 48-1. To this end, an oil groove 48-4 for communicating the outlet of the first oil supply passage 48-1 and the inlet of the second oil supply passage 48-2 may be provided in the vicinity of the inlet of the second oil supply passage 48-2. Therefore, the oil introduced into the first oil supply passage 48-1 is supplied to the back pressure chamber 23 through the second oil supply passage 48-2. Further, the intermediate housing 20 may be provided with a third oil supply passage 48-3 for supplying the oil supplied through the first oil supply passage 48-1 to the motor chamber 33.

Therefore, the oil separated in the oil separator 15 disposed in the refrigerant discharge chamber 13 of the front housing 10 is supplied to the back pressure chamber 23 through the first oil supply passage 48-1 provided in the fixed scroll 40 and the second oil supply passage 48-2 provided in the intermediate housing 20, thereby lubricating the intermediate bearing 25 disposed in the back pressure chamber 23 and the front bearing 55 disposed in the orbiting scroll 50. Further, the oil supplied to the motor chamber 33 through, the first oil supply passage 48-1 and the third oil supply passage 48-3 lubricates the friction parts of the driving motor 60.

As another example, the oil supply passage provided in the fixed scroll 40 may be provided with an orifice pin for reducing the pressure of the oil separated in the oil separator 15 and supplying the oil to the back pressure chamber 23.

Hereinafter, a scroll compressor provided with an orifice pin in an oil supply passage provided in a fixed scroll will be described in detail with reference to FIGS. 7 and 8.

Figure 7:
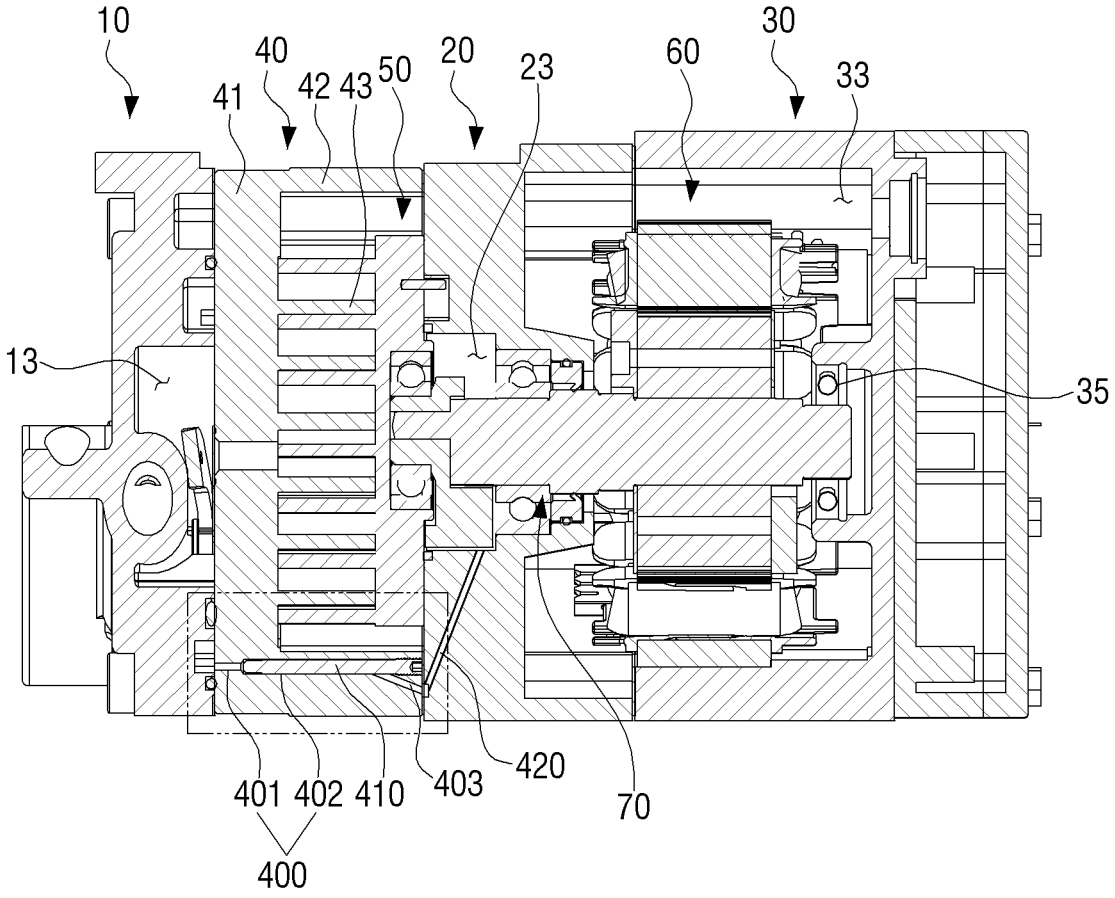
FIG. 7 is a cross-sectional view illustrating a scroll compressor according to another embodiment of the present disclosure.
Figure 8:
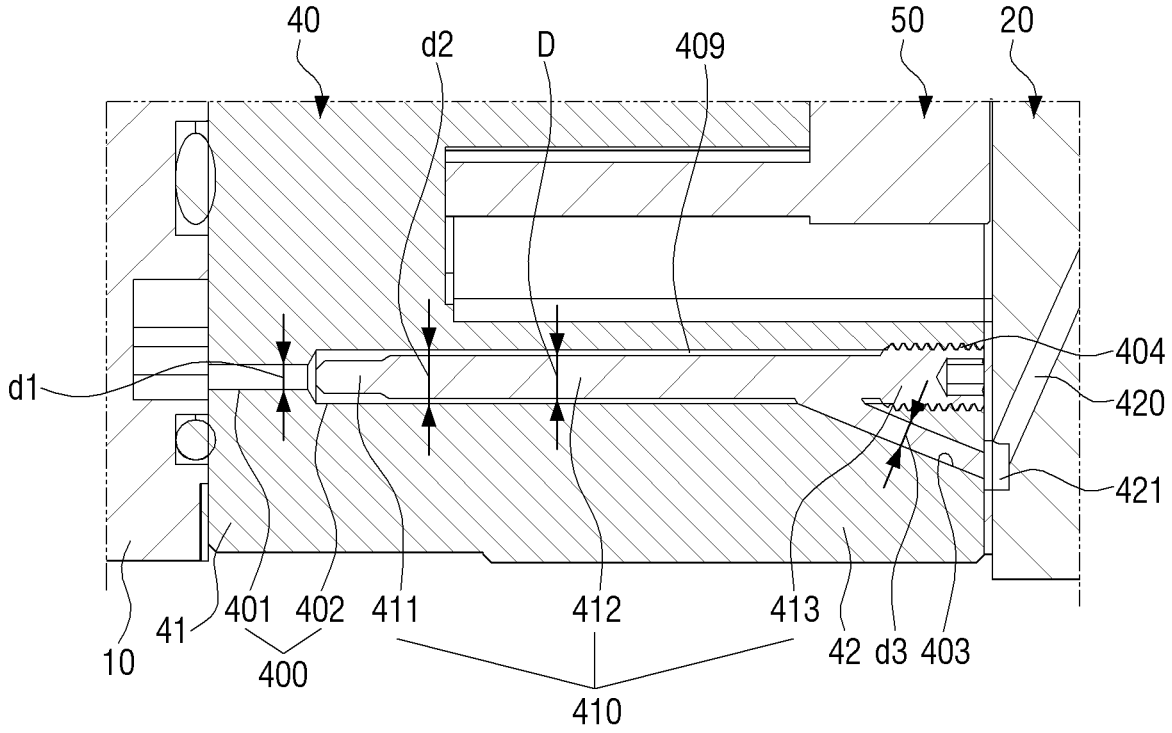
FIG. 8 is a partially enlarged cross-sectional view illustrating an oil supply passage of the scroll compressor of FIG. 7.

FIG. 7 is a cross-sectional view illustrating a scroll compressor according to another embodiment of the present disclosure, and FIG. 8 is a partially enlarged cross-sectional view illustrating an oil supply passage of the scroll compressor of FIG. 7.

Referring to FIGS. 7 and 8, a first oil supply passage 400 is provided to connect the refrigerant discharge chamber 13 provided in the front housing 10 and a second oil supply passage 420 provided in the intermediate housing 20.

The first oil supply passage 400 is formed as a through hole penetrating the fixed plate 41 and the skirt 42 of the fixed scroll 40. The first oil supply passage 400 may be formed in a stepped structure including at least one step. For example, the first oil supply passage 400 may include a first through hole 401 formed on one surface of the fixed scroll 40 and a second through hole 402 formed on the other surface of the fixed scroll 40 and communicated with the first through hole 401. At this time, the first through hole 401 and the second through hole 402 are formed in a straight line and the inner diameter d2 of the second through hole 402 is larger than the inner diameter d1 of the first through hole 401. Accordingly, the first through hole 401 and the second through hole 402 form a stepped structure. Further, a female screw portion 404 is provided at one end of the second through hole 402 adjacent to the other surface of the fixed scroll 40. A third through hole 403 communicating with the second through hole 402 is formed at one side of the female screw portion 404 on the other surface of the fixed scroll 40. At this time, the third through hole 403 is formed to be inclined with respect to the second through hole 402. The inner diameter d3 of the third through hole 403 may be smaller than the inner diameter d2 of the second through hole 402. For example, the inner diameter d3 of the third through hole 403 may be formed to be the same as the inner diameter d1 of the first through hole 401. One end of the third through hole 403 is provided to communicate with the second oil supply passage 402 of the intermediate housing 20. To this end, the intermediate housing 20 may be provided with an oil groove 421 for communicating one end of the third through hole 403 with the inlet of the second oil supply passage 420.

An orifice pin 410 is inserted into the second through hole 402. The orifice pin 410 may include a tip portion 411, a middle portion 412, and rear end portion 413, and may be formed in a stepped structure. When the orifice pin 410 is disposed in the first oil supply passage 400, the tip portion 411 of the orifice pin 410 is adjacent to the first through hole 401. The tip portion 411 of the orifice pin 410 has an outer diameter smaller than the outer diameter D of the middle portion 412. The rear end portion 413 of the orifice pin 410 has an outer diameter larger than the outer diameter D of the middle portion 412. The outer diameter D of the orifice pin 410, that is, the outer diameter D of the middle portion 412 of the orifice pin 410 is formed to be smaller than the inner diameter d2 of the first oil supply passage 400, that is, the inner diameter d2 of the second through hole 402 of the first oil supply passage 400. Therefore, a space 400 through which oil can pass is formed between the second through hole 402 and the tip portion 411 and the middle portion 412 of the orifice pin 410. The rear end portion 413 of the orifice pin 410 is provided with a male screw 413 corresponding to the female screw portion 404 of the second through hole 402.

Therefore, when the orifice pin 410 is inserted into the second through hole 402 and the male screw of the rear end portion 413 is fastened to the female screw portion 404 of the second through hole 402, the orifice pin 410 is fixed to the first oil supply passage 400. Thus the oil introduced into the first through hole 401 of the first oil supply passage 400 may flow through the space 409 formed between the outer surface of the orifice pin 410 and the inner surface of the second through hole 402, and then may be introduced into the third through hole 403. The oil discharged through the third through hole 403 is supplied to the back pressure chamber 23 through the second oil supply passage 420 provided in the intermediate housing 20.

When the orifice pin 410 is disposed in the first oil supply passage 400 of the fixed scroll 40 as described above, the oil separated in the oil separator 15 may be lowered in pressure and supplied to the back pressure chamber 23. Further, the orifice pin 410 has an advantage in that it is easy to manufacture and assemble because the shape of the orifice pin 410 is simpler than that of the screw-shaped flow path used in the conventional scroll compressor.

Referring again to FIGS. 2 and 3, the driving motor 60 is disposed in the interior of the rear housing 30, that is, in the motor chamber 33, and includes a stator 61 and a rotor 62. The stator 61 is fixed to the inner surface of the rear housing 30. The rotor 62 is rotatably inserted into the stator 41. Further, the rotary shaft 70 is inserted into the rotor 62 so as to penetrate therethrough.

The rotary shaft 70 includes a shaft portion 71 having a predetermined length and an eccentric portion 73 provided at one end of the shall portion 71. The shaft portion 71 of the rotary shaft 70 is press-fitted into the rotor 62 of the driving motor 60 and one end part of the shaft portion 71 is rotatably supported by the rear bearing 35 provided in the rear housing 30. The other end part of the shaft portion 71 is inserted into the protruding portion 21 of the intermediate housing 20 and is rotatably supported by the intermediate bearing 25 provided in the protruding portion 21. Further, a part a the shaft portion 71 of the rotary shall 70 adjacent to the intermediate bearing 25 is in contact with the second back pressure seal member 28 provided in the protruding portion 21 of the intermediate housing 20. Therefore, the back pressure chamber 23 provided in the intermediate housing 20 is sealed to the motor chamber 33 provided in the rear housing 30 by the second back pressure seal member 28, so that the intermediate pressure refrigerant in the back pressure chamber 23 is not leaked to the motor chamber 33 in the to pressure state.

The eccentric portion 73 of the rotary shaft 70 is rotatably supported by the front bearing 55 provided in the bearing groove 54 of the orbiting scroll 50. The center line C2 of the eccentric portion 73 is spaced apart from the center line C1 of the shaft portion 71 by a predetermined distance. Therefore, when the shaft portion 71 rotates, the eccentric portion 73 orbits around the center line C1 of the shall portion 71, so that the orbiting scroll 50 fixed to the eccentric portion 73 orbits around the center line C1 of the shaft portion 71.

A balance weight 74 is integrally provided in the eccentric portion 73 of the rotary shaft 70. The balance weight 74 may be disposed to rotate inside the back pressure chamber 23 of the intermediate housing 20. Therefore, when the rotary shall 70 rotates, the balance weight 74 rotates integrally with the eccentric portion 73 in the back pressure chamber 23.

The rear housing 30, the intermediate housing 20, the fixed scroll 40 and the front housing 10 as described above may be assembled in order in the axial direction to form the housing of the scroll compressor 1. At this time, the front housing 10, the fixed scroll 40, and the intermediate housing 20 may be connected and fixed to the rear housing 30 by a plurality of bolts 3. To this end, a plurality of tapped holes are provided in the rear housing 30, and a plurality of through holes through which the plurality of bolts 3 pass are provided in the front housing 10, the fixed scroll 40, and the intermediate housing 20.

Further, the scroll compressor 1 according to the present disclosure is a lateral scroll compressor in which the rotary shaft 70 of the driving motor 60 is disposed parallel to the ground. Accordingly, the front housing 10 and the rear housing 30 may be provided with a plurality of fixing portions 12 and 32 for fixing the scroll compressor 1 to the base. For example, as illustrated in FIG. 1, the scroll compressor 1 may include a fixing portion 12 provided one surface of the front housing 10 and two fixing portions 32 provided on both sides of the rear housing 30.

On the other hand, in the above-described embodiment, the housing is formed by assembling the front housing 10, the fixed scroll 40, the intermediate, housing 20, and the rear housing 30, but the structure of the housing is not limited thereto. Although not illustrated, as another example, the housing may be formed in a single cylindrical shape. In this case, a frame for holding the fixed scroll 40 and supporting both ends of the rotary shaft 70 of the driving motor 60 may be provided inside the housing.

Hereinafter, the operation of the scroll compressor according to an embodiment of the present disclosure will be described with reference to FIGS. 1 to 3.

First, when the power of the scroll compressor 1 is turned on, power is applied to the driving motor 60 to rotate the rotor 62 of the driving motor 60. When the rotor 62 of the driving motor 60 rotates, the rotary shaft 70 integrally coupled to the rotor 62 is rotated while being supported by the intermediate bearing 25 of the intermediate housing 20 and the rear bearing 35 of the rear housing 30. When the rotary shaft 70 rotates, the orbiting scroll 50 coupled to the eccentric portion 73 of the rotary shaft 70 performs an orbiting motion about the center line C1 of the rotary shaft 70. At this time, the orbiting scroll 50 is prevented from rotating by the anti-rotation rings 83 and the anti-rotation pins 82, and performs the orbiting motion.

When the orbiting scroll 50 performs the orbiting motion by the rotary shaft 70, the orbiting scroll wrap 53 of the orbiting scroll 50 is orbited in the state of being engaged with the fixed scroll wrap 43 of the fixed scroll 40. Thus, a plurality of compression pockets P are formed by the orbiting scroll wrap 53 and the fixed scroll wrap 43. The plurality of compression pockets P are moved to the center of the fixed scroll 40 and the orbiting scroll 50 and at the same time the volumes of the compression pockets P are changed so that the refrigerant is sucked and compressed in the compression pockets P. The compressed refrigerant is discharged to the refrigerant discharge chamber 13 through the discharge hole 45 of the fixed scroll 40. The oil is separated while the high-pressure refrigerant discharged to the refrigerant discharge chamber 13 of the front housing 10 through the discharge hole 45 passes through the oil separator 15. The oil-removed high-pressure refrigerant is discharged to the outside of the scroll compressor 1 through the discharge port 11 provided in the front housing 10.

Further, a part of the refrigerant compressed in the compression pockets P between the orbiting scroll wrap 53 and the fixed scroll wrap 43 is supplied to the back pressure chamber 23 through the back pressure hole 57 provided in the orbiting plate 51 of the orbiting scroll 50. The refrigerant supplied to the back pressure chamber 23 presses the orbiting scroll 50 forward (arrow B) so that the orbiting scroll 50 orbits in a state of maintaining a seal with respect to the fixed scroll 40.

The refrigerant flowing into the compression pockets P formed by the fixed scroll wrap 43 of the fixed scroll 40 and the orbiting scroll wrap 5 of the orbiting scroll 50 is introduced into the motor chamber 33 of the rear housing 30 through the suction port 31 formed on the side surface of the rear housing 30 (arrow F1). The low-pressure refrigerant introduced into the suction port 31 passes through the motor chamber 33 and flows into the compression chamber 49 provided in the fixed scroll 40 through the plurality of openings 29 of the intermediate housing 20 (arrows F2 and F3). The low-pressure refrigerant introduced into the compression chamber 40 of the fixed scroll 40 flows into the plurality of compression pockets P formed by the fixed scroll wrap 43 and the orbiting scroll wrap 53 and is compressed into high-pressure refrigerant.

On the other hand, the refrigerant compressed by the fixed scroll 40 and the orbiting scroll 50 at high pressure and discharged through the discharge hole 45 contains oil. While this high-pressure refrigerant passes through the oil separator 15, the oil is removed from the refrigerant. The oil separated by the oil separator 15 is supplied to the back pressure chamber 23 and the motor chamber 33 through the oil supply passages 48-1, 48-2, and 48-3.

The oil supplied to the back pressure chamber 23 lubricates the front bearing and the intermediate bearing 25 provided in the back pressure chamber 23. In addition, some of the oil lubricates between the orbiting scroll 50 and the first back pressure seal member 27 and between the plurality of anti-rotation rings 83 and the plurality of anti-rotation pins 83. Further, the oil supplied to the motor chamber 33 lubricates the rear bearing 35 provided in the rear housing 30.

Hereinafter, a scroll compressor according to another embodiment of the present disclosure will be described in detail with reference to FIGS. 9 to 11.

Figure 9:
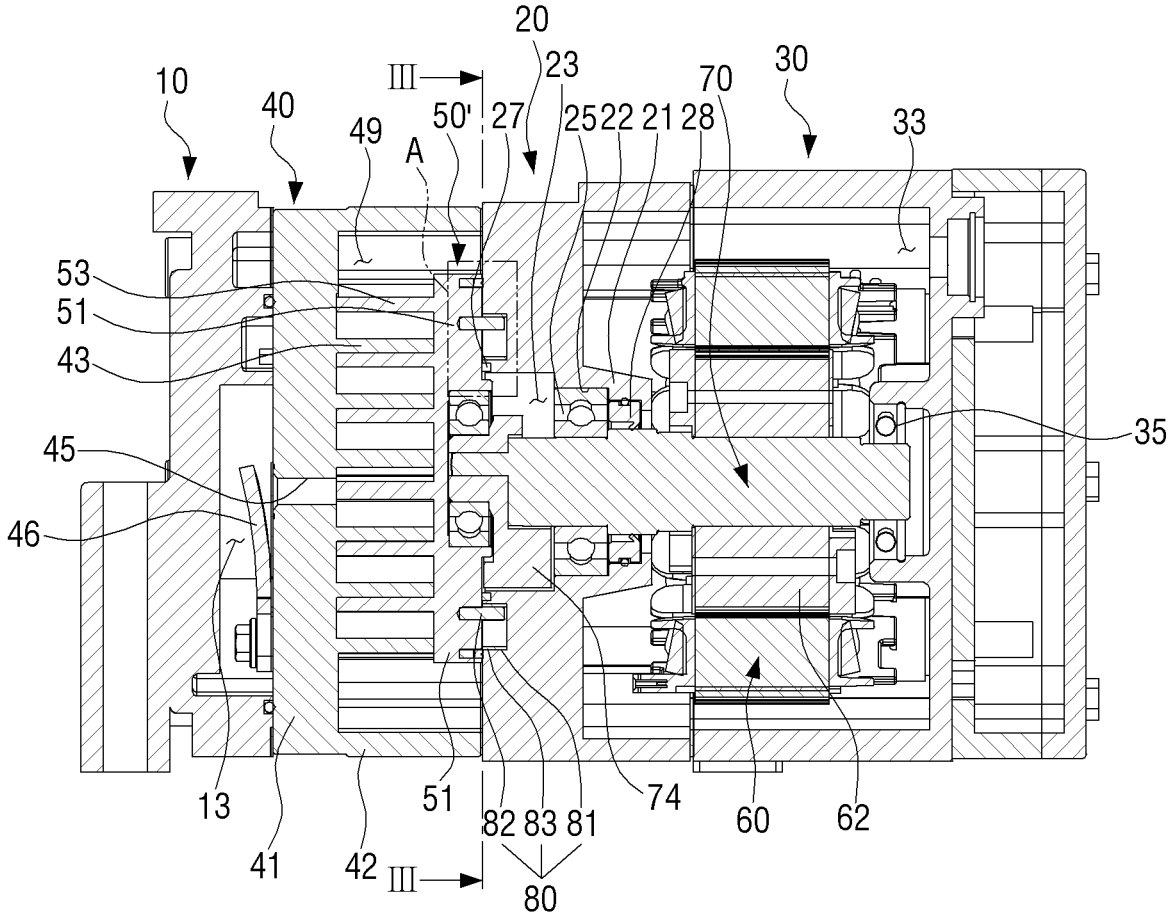
FIG. 9 is a cross-sectional view illustrating a scroll compressor according to another embodiment of the present disclosure.

FIG. 9 is a cross-sectional view illustrating a scroll compressor according to another embodiment of the present disclosure. FIG. 10 is a cross-sectional view of the scroll compressor of FIG. 9 taken along line III-III, and FIG. 11 is a partially enlarged cross-sectional view illustrating a part A of FIG. 10. FIG. 12 is a partially enlarged cross-sectional view illustrating another example of a second back pressure chamber member used in the scroll compressor of FIG. 9.

Figure 10:
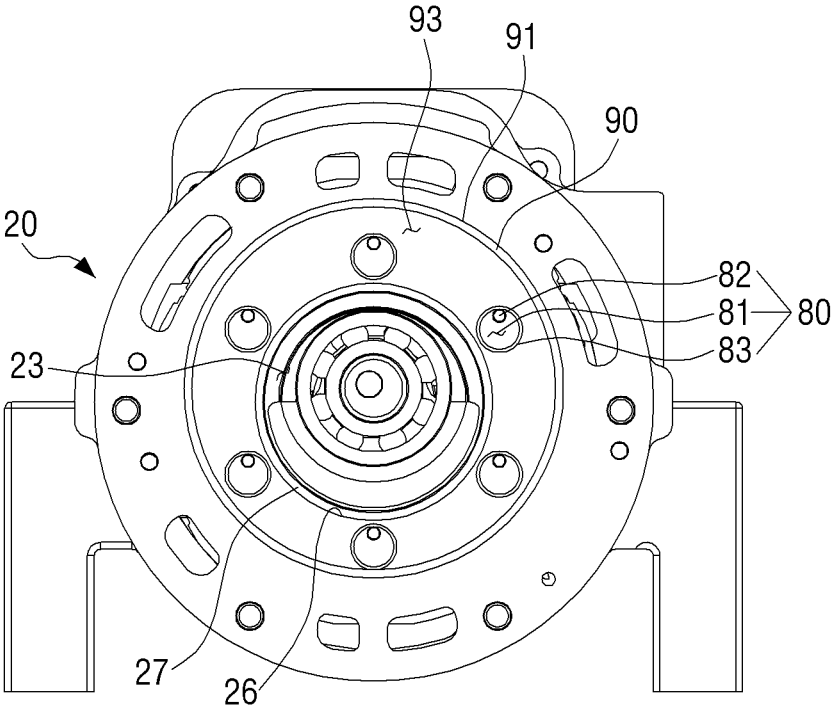
FIG. 10 is a cross-sectional view of the scroll compressor of FIG. 9 taken along line III-III.
Figure 11:
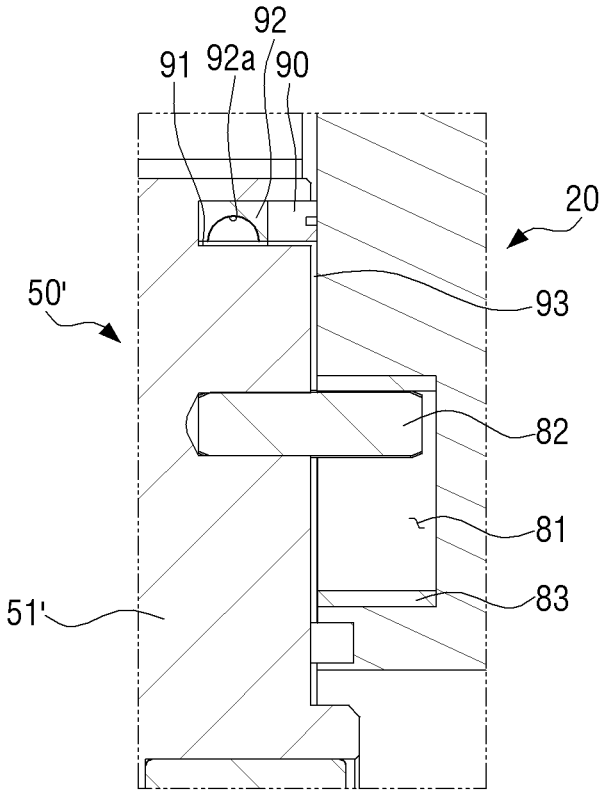
FIG. 11 is a partially enlarged cross-sectional view illustrating a part A of FIG. 10.
Figure 12:
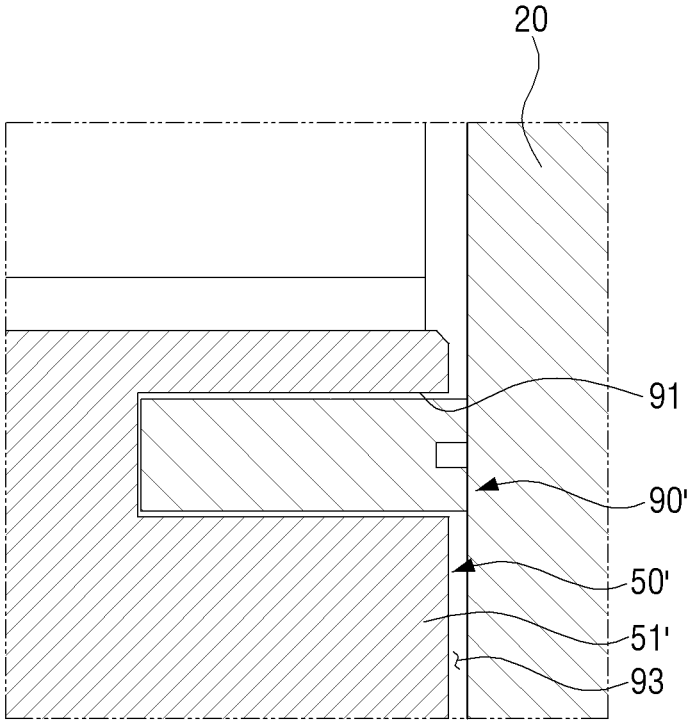
FIG. 12 is a partially enlarged cross-sectional view illustrating another example of a second back pressure chamber member used in the scroll compressor of FIG. 9.

Referring to FIGS. 9 to 11, a scroll compressor 1' according to an embodiment of the present disclosure may include a housing 10, 20, and 30, a fixed scroll 40, an orbiting scrod 50', and a driving motor 60.

The housing 10, 20, and 30 forms the outer appearance of the scroll compressor 1' and may include a front housing 10, an intermediate housing 20, and a rear housing 30. The front housing 10 is provided with a discharge port 11 (see FIG. 1) for discharging the refrigerant. The rear housing 30 is provided with a suction port 31 (see FIG. 1) through which the refrigerant is sucked. Therefore, the refrigerant introduced into suction port 31 of the rear housing 30 passes through the interior of the housing and is discharged to the outside of the scroll compressor through the discharge port 11 of the front housing 10. The inside of the rear housing 30 forms a motor chamber 33 in which the driving motor 60 is disposed.

The intermediate housing 20 is disposed on one side of the rear housing 30 and is configured to support one end part of the driving motor 60, that is, one end part of the rotary shaft 70. A refrigerant compression mechanism is provided between the intermediate housing 20 and the front housing 10.

Referring to FIGS. 9 and 10, the intermediate housing 20 is formed in a disc shape and a protruding portion 21 is formed on one surface of the intermediate housing 20 facing the rear housing 30. A shaft support hole 22 is formed in the protruding portion 21 of the intermediate housing 20 and an intermediate bearing 25 is provided in the shaft support hole 22. A shaft portion 71 of the rotary shaft 70 is inserted into the intermediate bearing 25, so that the intermediate bearing 25 support the rotation of the rotary shaft 70. Further, the intermediate housing 20 is provided with a back pressure chamber 23 having an inner diameter larger than the inner diameter of the shaft support hole 22 at one side of the shaft support hole 22. The back pressure chamber 23 is formed in a groove shape having a circular cross-section in one surface of the intermediate housing 20.

An annular seal member groove 26 is provided around the back pressure chamber 23 in one surface of the intermediate housing 20. The seal member groove 26 is provided with a first back pressure seal member 27 for sealing a gap between the orbiting scroll 50 and the intermediate housing 20. The first back pressure seal member 27 may be disposed to be movable in a direction perpendicular to the one surface of the intermediate housing 20, that is, in the axial direction of the scroll compressor 1' with respect to the seal member groove 26. Therefore, the tip end of the first back pressure seal member 27 disposed in the seal member groove 26 contacts the orbiting scroll 50 to prevent the refrigerant in the back pressure chamber 23 from flowing out of the back pressure chamber 23.

In addition, an anti-rotation mechanism 80 is provided between the orbiting scroll 50' and the intermediate housing 20 to prevent the orbiting scroll 50' from rotating. For example, the anti-rotation mechanism 80 may include a plurality of anti-rotation ring grooves 81 provided in a circular shape around the seal member groove 26 of the intermediate housing 20 and a plurality of anti-rotation pins 82 provided in a circular shape on one surface of the orbiting scroll 50' facing the intermediate housing 20. The plurality of anti-rotation ring grooves 81 provided in the intermediate housing 20 are thrilled in grooves having a circular cross-section with a predetermined depth. The plurality of anti-rotation pins 82 provided in the orbiting scroll 50' are provided in the same number as the plurality of anti-rotation ring grooves 81 of the into housing 20 and are inserted into the plurality of anti-rotation ring grooves 81. Further, a plurality of anti-rotation rings 83 may be inserted into the plurality of anti-rotation ring grooves 81. In this case, when the orbiting scroll 50' is orbited by the driving motor 60, the rotation of the orbiting scroll 50' may be prevented because the movement of the plurality of anti-rotation pins 82 of the orbiting scroll 50' is restricted by the plurality of anti-rotation rings 83 inserted into the plurality of anti-rotation ring grooves 81 of the intermediate housing 20.

A second back pressure seal member 28 is provided at one end of the back pressure chamber 23 provided in the intermediate housing 20. For example, the second back pressure seal member 28 may be disposed at one side of the intermediate bearing 25 at one end of the protruding portion 21 provided in the intermediate housing 20. The second back pressure seal member 28 is provided to seal a gap between the rotary shaft 70 of the driving motor 60 and the intermediate housing 20. A lip seal may be used as the second back pressure seal member 28.

A plurality of openings 29 axially penetrating the intermediate housing 20 are formed near the outer circumferential surface of the intermediate housing 20. The plurality of openings 29 are provided in a circular shape concentric with the center of the intermediate housing 20. The plurality of openings 29 allow the motor chamber 33 of the rear housing 30 in which the driving motor 60 is disposed to communicate with the compression chamber 49 provided in the fixed scroll 40 so that the to refrigerant flowing in through the suction port 31 provided in the rear housing 30 may be introduced into the compression chamber 49. Therefore, as illustrated in FIG. 10, the intermediate housing 20 includes the back pressure chamber 23, the plurality of ring grooves 81, and plurality of openings 29 concentrically provided on the one surface of the intermediate housing 20.

The fixed scroll 40 is disposed on the opposite side of the rear housing 30 at one side of the intermediate housing 20. The orbiting scroll 50' is accommodated in a space 49 formed by the fixed scroll 40 and the intermediate housing 20. The orbiting scroll 50' is disposed between the fixed scroll 40 and the intermediate housing 20 to mesh with the fixed scroll 40 and orbit with respect to the fixed scroll 40. The fixed scroll 40 and the orbiting scroll 50' form a compression mechanism for compressing the refrigerant.

The fixed scroll 40 includes a fixed plate 41 and a fixed scroll wrap 41. The fixed plate 41 is formed in a substantially disc shape and the fixed scroll rap 43 is formed in an involute curve shape having a predetermined thickness and height on one surface of the fixed plate 41. At the center of the fixed plate 41, a discharge hole 45 penetrating the fixed plate 41 is formed. A discharge valve 46 is provided in the discharge hole 45 to prevent the refrigerant from flowing backward.

In addition, a cylindrical skirt 42 is provided at the outer periphery of the fixed plate 41. The skirt 42 surrounds the space between the fixed plate 41 and the intermediate housing 20 and forms a space in which the orbiting scroll 50' can orbit. The skirt 42 extends in the axial direction from the outer periphery of the fixed plate 41 and is formed as a single body with the fixed plate 41.

The orbiting scroll 50' includes an orbiting plate 51' and an orbiting scroll wrap 53. The orbiting plate 51' is formed in a disc shape. The orbiting scroll wrap 53 is provided on one surface of the orbiting plate 51' facing the fixed scroll 40 and is formed in an involute curve shape having a predetermined thickness and height. The orbiting scroll wrap 53 is formed to mesh with the fixed scroll wrap 43 of the fixed scroll 40. A space formed between the fixed scroll wrap 43 of the fixed scroll 30 and the orbiting scroll wrap 53 of the orbiting scroll 50' forms a compression pocket P for compressing the refrigerant. Therefore, when the orbiting scroll 50' orbits, the refrigerant is compressed by the compression pockets P between the orbiting scroll wrap 53 and the fixed scroll wrap 43 and then discharged through the discharge hole 45 of the fixed scroll 40.

A bearing groove 54 is provided at the center of one surface of the orbiting plate 51' opposite to the surface on which the orbiting scroll wrap 53 is formed. The bearing groove 54 is provided with a front bearing 55 for rotatably supporting the one end part of the rotary shalt 70.

In addition, as illustrated in FIG. 11, a sub-seal member groove 91 is provided on one surface of the orbiting plate 51' provided with the bearing; groove 54, adjacent to the outer periphery of the orbiting plate 51'. The sub-seal member groove 91 is formed as an annular groove, and is formed in the orbiting plate 51' in a concentric manner with the bearing groove 54. The sub-seal member groove 91 is provided to surround the plurality of anti-rotation pins 82 provided on the orbiting scroll 50'. A ring-shaped third back pressure seal member 90 may be provided in the sub-seal member groove 91. The third back pressure seal member 90 may be disposed to be movable in the direction perpendicular to the orbiting plate 51' with respect to the sub-seal member groove 91, that is in the axial direction of the scroll compressor 1'. The third back pressure seal member 90 may surround the plurality of anti-rotation rings 83 provided in the intermediate housing 20 and may seal a gap between the orbiting scroll 50' and the intermediate housing 20.

A backup seal member 92 for supporting the third back pressure seal member 90 may be disposed in the sub-seal member groove 91. The backup seal member 92 may be formed of an elastic material. The backup seal member 92 is formed in a ring shape, and an oil groove **92*a* having a semicircular cross-section is provided along the inner circumferential surface of the backup seal member 92. When the oil of a sub-back pressure chamber 93 enters the sub-seal member groove 91 through the gap between the third back pressure seal member 90 and the side surface of the sub-seal member groove 91 and fills the oil groove 92*a* of the backup seal member 92, the backup seal member 92 presses the third back pressure seal member 90. Thus, the third back pressure seal member 90 moves in the axial direction and one end of the third back pressure seal member 90 comes into contact with one surface of the intermediate housing 20, thereby sealing a gap between the orbiting scroll 50' and the intermediate housing 20**.

However, it is not necessary to provide the third back pressure seal member 90 in the sub-seal member groove 91 so as to be supported by the backup seal member 92. For example, as illustrated in FIG. 12, a third back pressure seal member 90' may be disposed in the sub-seal member groove 91 without the backup seal member 92. In other words, only the third back pressure seal member 90' may be provided in the sub-seal member groove 91.

When the third back pressure seal member 90 is disposed in the sub-seal member groove 91 of the orbiting scroll 50', the sub-back pressure chamber 93 is formed between the orbiting scroll 50' and the intermediate housing 20 by the third back pressure seal member 90. In detail, as illustrated in FIG. 11, the sub-back pressure chamber 93 is formed as a space formed by one surface of the intermediate housing 20 in which the first back pressure seal member 27 is disposed, one surface of the orbiting scroll 50' facing the intermediate housing 20, the first back pressure seal member 27 provided in the intermediate housing 20, and the third back pressure seal member 90 provided in the orbiting scroll 50'. Because the sob-back pressure chamber 93 is formed in a ring shape, as illustrated in FIG. 10, the plurality of anti-rotation rings 83 and the plurality of anti-rotation pins 82 are positioned in the sub-back pressure chamber 93. Therefore, the oil supplied from the back pressure chamber 23 by the orbiting movement of the orbiting scroll 50' is collected in the sub-back pressure chamber 93 by the third back pressure seal member 90, so that the oil may be supplied to the anti-rotation mechanism 80 constituted by the plurality of anti-rotation rings 83 and the plurality of anti-rotation pins 82.

On the other hand, two back pressure holes 95 and 96 may be provided in the orbiting scroll 50' to generate a back pressure by introducing the high-pressure refrigerant into the back pressure chamber 23 and the sub-back pressure chamber 93.

Hereinafter, the two back pressure holes provided in the orbiting scroll will be described in detail with reference to FIGS. 13 and 14.

Figure 13:
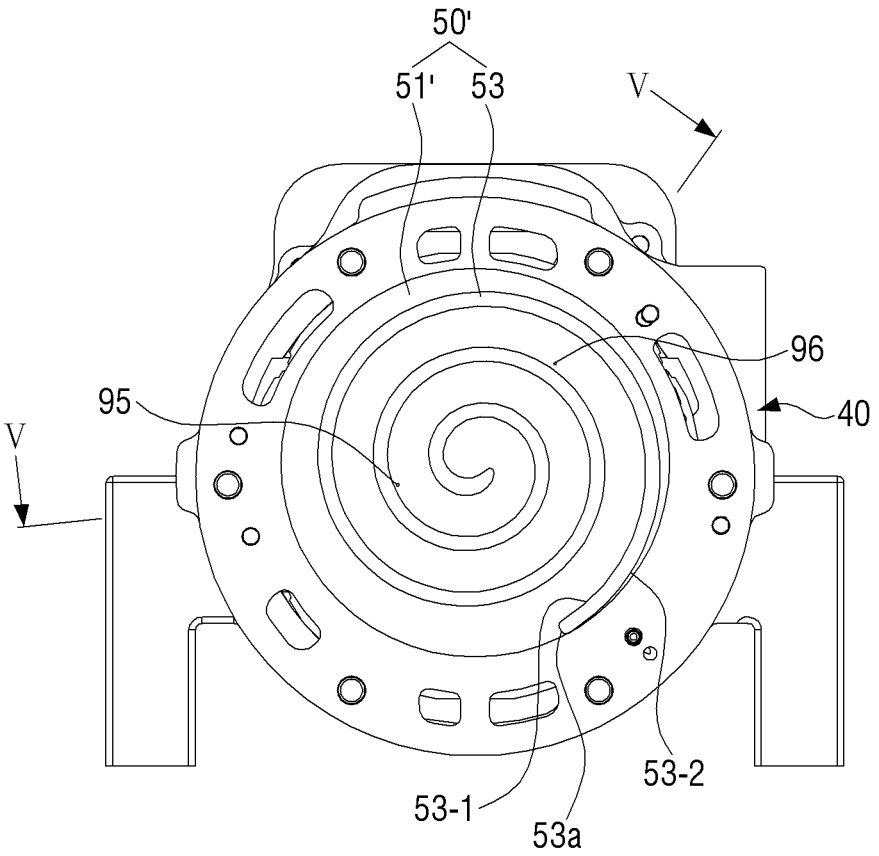
FIG. 13 is a cross-sectional view of the scroll compressor of FIG. 9 taken along line IV-IV.
Figure 14:
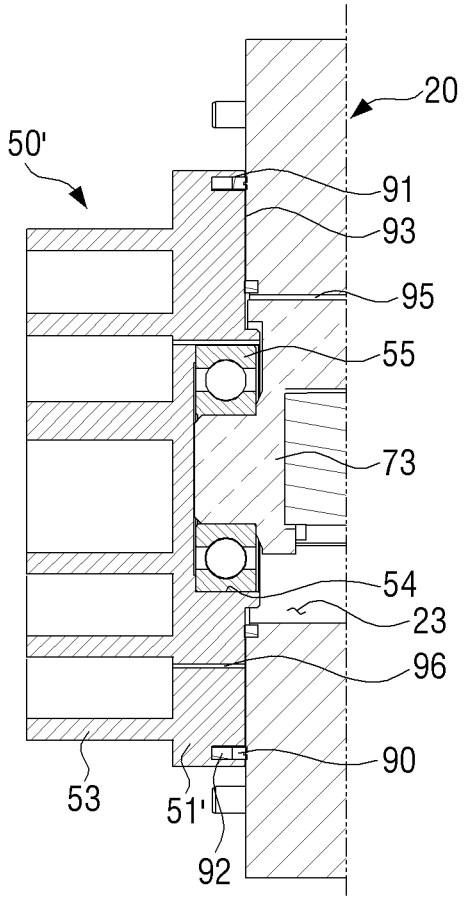
FIG. 14 is a partial cross-sectional view of the scroll compressor of FIG. 13 taken along line V-V.

FIG. 13 is a cross-sectional view of the scroll compressor of FIG. 9 taken along line IV-IV, and FIG. 14 is a partial cross-sectional view illustrating the scroll compressor of FIG. 13 taken along line V-V.

Referring to FIGS. 13 and 14, a first back pressure hole 95 for connecting the compression pocket P and the back pressure chamber 23 and a second back pressure hole 96 for connecting the compression pocket P and the sub-back pressure chamber 93 are provided in the orbiting plate 51' of the orbiting scroll 50'. At this time, the first back pressure hole 95 and the second back pressure bole 96 are formed to penetrate the orbiting plate 51'. The first back pressure bole 95 is formed in one side of the back pressure chamber 23 in the vicinity of the inner circumferential surface 53-1 of the orbiting scroll wrap 53, that is, the inner involute curved surface of the orbiting scroll wrap 53. The second back pressure hole 96 is formed in one side of the sub-back pressure chamber 93 in the vicinity of the outer circumferential surface 53-2 of the orbiting scroll wrap 53, that is, the outer involute curved surface of the orbiting scroll wrap 53. Here, the surface facing the center of the orbiting scroll wrap 53 on the basis of the end 53*a* of the orbiting scroll wrap 53 is referred to as the inner circumferential surface 53-1 of the orbiting scroll wrap 53, and the surface facing the outside is referred to as the outer circumferential surface 53-2 of the orbiting scroll wrap 53.

Therefore, a part of the high-pressure refrigerant compressed by the orbiting scroll 50' and the fixed scroll 40 flows into the back pressure chamber 23 through the first back pressure hole 95, and the other part of the high-pressure refrigerant flow s into the sub-back pressure chamber 93 through the second back pressure hole 96. Thus, the refrigerant flowing into the back pressure chamber 23 and the sub-back pressure chamber 93 presses the orbiting scroll 50' in the axial direction of the scroll compressor 1' toward the fixed scroll 40 at an intermediate pressure. At this time, the back pressure applied to the orbiting scroll 50' by the back pressure chamber 23 and the sub-back pressure chamber 93 is an intermediate pressure that is lower than the pressure of the refrigerant discharged through the discharge hole 45 of the fixed scroll 40 and is higher than the pressure of the refrigerant introduced through the suction port 31 of the rear housing 30.

As described above, when first back pressure hole 95 for allowing the refrigerant to flow into the back pressure chamber 23 is formed at a position adjacent to the inner circumferential surface 53-1 of the orbiting scroll wrap 53 and the second back pressure hole 96 for allowing the refrigerant to flow into the sub-back pressure chamber 93 is formed at a position adjacent to the outer circumferential surface 53-2 of the orbiting scroll wrap 53, the high-pressure refrigerant compressed by the plurality of compression pockets V formed by the fixed scroll wrap 43 and the orbiting scroll wrap 53 may be supplied to the back pressure chamber 23 and the sub-back pressure chamber 93 in a balanced manner. Therefore, the orbiting scroll 50' may stably orbit.

The driving motor 60 allows the orbiting scroll 50' to orbit and is disposed in the rear housing 30. The structure of the driving motor 60 is the same as that of the driving motor 60 of the scroll compressor 1 according to the above-described embodiment; therefore, detailed description thereof is omitted.

Hereinafter, the operation of the scroll compressor according to an embodiment of the present disclosure having the structure as described above will be described with reference to FIGS. 9 to 11.

First, when the power of the scroll compressor 1' is turned on, power is applied to the driving motor 60 to rotate the rotor 62 of the driving motor 60. When the rotor 62 of the driving motor 60 rotates, the rotary shaft 70 integrally coupled to the rotor 62 is rotated while being supported by the intermediate bearing 25 of the intermediate housing 20 and the rear bearing 35 of the rear housing 30. When the rotary shaft 70 rotates, the orbiting scroll 50' coupled to the eccentric portion 73 of the rotary shaft 70 performs an orbiting motion about the center line of the rotary shaft 70. At this time, the orbiting scroll 50' is prevented from rotating by the anti-rotation rings 83 and the anti-rotation pins 82, and performs the orbiting motion.

When the orbiting scroll 50' performs the orbiting motion by the rotary shaft 70, the orbiting scroll wrap 53 of the orbiting scroll 50' orbits in the state of being engaged with the fixed scroll wrap 43 of the fixed scroll 40. Thus, the plurality of compression pockets P are formed by the orbiting scroll wrap 53 and the fixed scroll wrap 43. The plurality of compression pockets P are moved toward the center of the fixed scroll 40 and the orbiting scroll 50' and at the same time the volumes of the compression pockets P are changed so that the refrigerant is sucked and compressed in the compression pockets P. The compressed refrigerant is discharged through the discharge hole 45 of the fixed scroll 40. The oil is separated while the high-pressure refrigerant discharged to the refrigerant discharge chamber 13 of the front housing 10 through the discharge hole 45 passes through the oil separator 15. The oil-removed high-pressure refrigerant is discharged to the outside of the scroll compressor 1' through the discharge port 11 provided in the front housing 10.

Further, a part of the refrigerant compressed in the compression pockets P between the orbiting scroll wrap 53 and the fixed scroll wrap 43 is supplied to the back pressure chamber 23 through the first back pressure hole 95 provided in the orbiting plate 51' of the orbiting scroll 50'. Another part of the refrigerant is supplied to the sub-back pressure chamber 93 through the second back pressure hole 96 provided in the orbiting plate 51'. The refrigerant supplied to the back pressure chamber 23 and the sub-back pressure dumber 93 presses the orbiting scroll 50' forward in the axial direction, so that the orbiting scroll 50' orbits in a state of maintaining a seal with respect to the fixed scroll 40.

The refrigerant flowing into the compression pockets P formed by the fixed scroll wrap 43 and the orbiting scroll wrap 53 is introduced into the motor chamber 33 of the rear housing 30 through the suction port 31 formed on the side surface of the rear housing 30. The low-pressure refrigerant introduced into the motor chamber 33 flows into the compression chamber 49 provided in the fixed scroll 40 through the plurality of openings 29 of the intermediate housing 20 and then flows into the plurality of compression pockets P formed by the fixed scroll wrap 43 and the orbiting scroll wrap 53.

On the other hand, the refrigerant compressed at a high pressure by the fixed scroll 40 and the orbiting scroll 50' and discharged through the discharge hole 45 contains oil. The oil contained in the high-pressure refrigerant is removed by the oil separator 15 provided in the refrigerant discharge camber 13. The removed oil is supplied to the back pressure chamber 23 and the motor chamber 33 through the oil supply passages, and lubricates the friction portions.

The present disclosure has been described above by way example. The terms used herein are for the purpose of description and should not be construed as limiting. Various modifications and variations of the present disclosure are possible in light of the above teachings. Therefore, the present disclosure can be freely carried out within the scope of the claims unless otherwise specified.

The invention claimed is:

1. A scroll compressor including a housing, a driving motor accommodated in the housing, an orbiting scroll orbited by the driving motor, a fixed scroll disposed in the housing and forming a compression chamber together with the orbiting scroll, a suction port provided in the housing at one side of the driving motor and configured to suck refrigerant, an oil separator provided in the housing at one side of the fixed scroll and configured to separate oil from the refrigerant discharged from the fixed scroll, and a discharge port configured to discharge the refrigerant from which the oil has been separated in the oil separator to an outside of the housing, the scroll compressor further comprising:

an intermediate housing disposed in the housing and rotatably supporting a rotary shaft of the driving motor;

a back pressure chamber provided in the intermediate housing at one side of the orbiting scroll;

a first back pressure seal member disposed in the intermediate housing to surround a periphery of the back pressure chamber and configured to seal a gap between the orbiting scroll and the intermediate housing;

a second back pressure seal member disposed in the intermediate housing at one end of the back pressure chamber and configured to seal a gap between the rotary shaft and the intermediate housing;

a plurality of anti-rotation rings disposed in a plurality of anti-rotation ring grooves of the intermediate housing and positioned at an outer side of the first back pressure seal member;

a plurality of anti-rotation pins provided in the orbiting scroll and inserted into the plurality of anti-rotation rings, respectively;

an oil supply passage through which the oil separated by the oil separator moves to the back pressure chamber, the oil supply passage provided between the oil separator and the back pressure chamber; and an orifice pin disposed in the oil supply passage and including a tip portion, a middle portion, and a rear end portion which sequentially increase in diameter.

2. The scroll compressor of claim 1, wherein the oil supply passage comprises a first oil supply passage provided in the fixed scroll and a second oil supply passage provided in the intermediate housing and communicated with the first oil supply passage.

3. The scroll compressor of claim 2, wherein an outer diameter of each portion of the orifice pin is smaller than an inner diameter of the first oil supply passage.

4. The scroll compressor of claim 2, wherein the first oil supply passage is formed in a stepped structure including at least one step and the orifice pin is formed in a stepped structure corresponding to the stepped structure of the first oil supply passage.

5. The scroll compressor of claim 1, wherein the intermediate housing is provided with an annular seal member groove at an outer side of the back pressure chamber, and wherein the first back pressure seal member is disposed in the annular seal member groove.

6. The scroll compressor of claim 1, further comprising:

a third back pressure seal member disposed in the orbiting scroll to surround the plurality of anti-rotation rings and configured to seal a gap between the orbiting scroll and the intermediate housing.

7. The scroll compressor of claim 6, further comprising:

a sub-back pressure chamber formed between the first back pressure seal member and the third back pressure seal member and configured to supply the oil to the plurality of anti-rotation rings.

8. The scroll compressor of claim 7, wherein the orbiting scroll is provided with a first back pressure hole communicating the back pressure chamber with the compression chamber, and wherein the first back pressure hole is formed adjacent to an inner circumferential surface of an orbiting scroll wrap of the orbiting scroll.

9. The scroll compressor of claim 8, wherein the orbiting scroll is provided with a second back pressure hole communicating the sub-back pressure chamber with the compression chamber, and wherein the second back pressure hole is formed adjacent to an outer circumferential surface of the orbiting scroll wrap of the orbiting scroll.

10. The scroll compressor of claim 6, wherein the orbiting scroll includes an annular sub-seal member groove formed at an outer side of the plurality of anti-rotation pins; and wherein the third back pressure seal member is disposed in the annular sub-seal member groove.

11. The scroll compressor of claim 10, wherein a backup seal member supporting the third back pressure seal member is provided in the sub-seal member groove.

12. A scroll compressor including a housing, a driving motor accommodated in the housing, an orbiting scroll orbited by the driving motor, a fixed scroll disposed in the housing and forming a compression chamber together with the orbiting scroll, a suction port provided in the housing at one side of the driving motor and configured to suck refrigerant, an oil separator provided in the housing at one side of the fixed scroll and configured to separate oil from the refrigerant discharged from the fixed scroll, and a discharge port configured to discharge the refrigerant from which the oil has been separated in the oil separator to an outside of the housing, the scroll compressor comprising:

an intermediate housing disposed in the housing and rotatably supporting a rotary shaft of the driving motor;

a back pressure chamber provided in the intermediate housing at one side of the orbiting scroll;

a first back pressure seal member disposed in the intermediate housing to surround a periphery of the back pressure chamber and configured to seal a gap between the orbiting scroll and the intermediate housing;

a second back pressure seal member disposed in the intermediate housing at one end of the back pressure chamber and configured to seal a gap between the rotary shaft and the intermediate housing; and an orifice pin provided in an oil supply passage formed between the oil separator and the back pressure chamber and configured to supply the oil separated in the oil separator to the back pressure chamber, wherein the orifice pin includes a tip portion, a middle portion, and a rear end portion which sequentially increases in diameter.

13. The scroll compressor of claim 12, further comprising:

an anti-rotation mechanism provided outside the first back pressure seal member and configured to prevent rotation of the orbiting scroll.

14. The scroll compressor of claim 13, further comprising:

a third back pressure seal member provided in the orbiting scroll to surround the anti-rotation mechanism, the third back pressure seal member configured to seal a gap between the orbiting scroll and the intermediate housing and to form a sub-back pressure chamber.

* * * * *